United States Patent [19]

Benson et al.

[11] Patent Number: 4,725,095

[45] Date of Patent: Feb. 16, 1988

[54] VEHICLE SEAT WITH MECHANICAL LUMBAR SUPPORT HAVING TWO DEGREES OF FREEDOM

[75] Inventors: Joseph B. Benson, South Lyon; Leon J. Eberly, Livonia, both of Mich.

[73] Assignee: Johnson Service Company, Milwaukee, Wis.

[21] Appl. No.: 884,807

[22] Filed: Jul. 11, 1986

[51] Int. Cl.[4] ..... A47C 7/46

[52] U.S. Cl. ..... 297/284; 297/460

[58] Field of Search ..... 297/460, 284

[56] References Cited

U.S. PATENT DOCUMENTS

| | | | |
|---|---|---|---|
| 3,106,423 | 10/1963 | Schwarz | 297/284 |
| 4,159,847 | 7/1979 | Arai | 297/284 |
| 4,162,807 | 7/1979 | Yoshimura | 297/284 |
| 4,296,965 | 10/1981 | Sakurada et al. | 297/284 |
| 4,449,751 | 5/1984 | Murphy et al. | 297/284 |
| 4,576,410 | 3/1986 | Hattori | 297/284 |
| 4,588,172 | 5/1986 | Fourrey et al. | 297/284 X |
| 4,623,193 | 11/1986 | Lieker | 297/284 |

FOREIGN PATENT DOCUMENTS

| | | | |
|---|---|---|---|
| 2856784 | 7/1979 | Fed. Rep. of Germany | 297/284 |
| 1536132 | 12/1978 | United Kingdom | 297/284 |
| A2059497 | 4/1981 | United Kingdom | 297/284 |

*Primary Examiner*—Peter A. Aschenbrenner

*Assistant Examiner*—Thomas A. Rendos

*Attorney, Agent, or Firm*—Harness, Dickey, Pierce

[57] ABSTRACT

A vehicle seat with a mechanism in the back of the seat which provides support for the lumbar region of the back of the seat occupant, the mechanism being mechanically adjustable to vary the magnitude of the support provided the occupant's back. The mechanism is characterized by the fact that it provides two degrees of freedom to adapt the mechanism to a particular seat occupant thereby providing the desired user comfort. The mechanism consists of a support member mounted on linkage so that the support member is moveable in and out in a direction laterally of the seatback to provide one degree of freedom and is pivotally moveable about an axis extending transversely of the seatback to adapt the slope of the support to the slope of the occupant's back to thereby impart the second degree of freedom. The seatback suspension springs fasten to the lumbar linkage to prevent discontinuities in back support from developing at any position of the lumbar system. The support member is assymmetrically pivoted and spring loaded to bias the lumbar support to its upper portion and thereby provide some upper torso support. A control cam is specifically configured to enable easy adjustment of the first degree of freedom and the seat occupant is moveable in the seat to achieve the second degree of freedom.

3 Claims, 7 Drawing Figures

VEHICLE SEAT WITH MECHANICAL LUMBAR SUPPORT HAVING TWO DEGREES OF FREEDOM

BACKGROUND OF THE INVENTION

This invention relates generally to seating in which the back of the seat includes structure that is aligned with the lumbar region of the seat occupant to reduce back fatigue and more particularly, to a vehicle seat having a mechanically adjustable back support member that is aligned with the lumbar region of the user and is mechanically adjustable to vary the support provided by the back support member. The mounting of the lumbar support member is configured so that the support member has two degrees of freedom of movement to thereby increase the ability of the support member to adapt itself to the support required by each individual seat occupant.

Lumbar supports of the general type embodied in vehicle seats are known, as illustrated by U.S. Pat. No. 4,576,410. However, lumbar supports of this general type that are known do not incorporate the two degrees of freedom advantage obtained by the lumbar support of this intention. Furthermore, the present invention provides an improved cam control for maintaining the lumbar support in adjusted positions. The cam has advantageous characteristics that make it useable in other enviornments. In addition the seatback suspension is integrated with the lumbar support system to prevent a discontinuity in back support from developing when the lumbar system is deployed.

SUMMARY OF THE INVENTION

The lumbar support of this invention comprises a plate or paddle shape lumbar support member which extends transversely of the back frame in the seat. An adjustable support link mounts the lumbar support member on the frame for in and out movement in a direction laterally of the frame to vary the magnitude of the occupant support obtainable from the lumbar member. This in and out movement in a direction laterally of the frame constitutes one of the two degrees of freedom which characterize this invention.

The lumbar plate is also pivotally mounted on its support for limited pivotal movement about an axis extending transversely of the back frame to enable the lumbar member to move in response to occupant pressure and thereby adapt its position to the seat occupant. The lumbar plate can then adjust to a sloped position corresponding to the slope of the seat occupant's back. The seatback suspension attaches to the lumbar system linkage to prevent the development of a drop-off or discontinuity in back support, as the lumbar support member is deployed outward for increased support. This allows the back to assume a contour corresponding to the normal standing posture of the seat occupant which is the desired position for comfort purposes. This pivotal movement of the lumbar plate constitutes the second degree of freedom which characterizes the lumbar support of this invention.

In addition, the lumbar plate is fastened to the linkage so that its center of pressure is above its pivot axis. This geometry, interacted with the support from the seatback suspension springs, biases the lumbar support force to the upper portion of the plate to provide an upward component of force or "thoracic thrust." This serves to partially support torso weight that would normally be carried by the lumbar vertebrae.

The lumbar member is moved in and out in a direction laterally of the back frame by manipulation of a hand operated handle, lever or knob mounted on the back frame. Movement of the lever causes movement of a cam which bears on a follower forming part of the linkage mechanism that moves the lumbar support member in and out. The cam has a particular configuration to enable it to hold the lumbar support member in any one of several predetermined adjusted positions and move smoothly between these positions in response to minimum force on the actuating handle.

The result is a mechanically operated lumbar support system which is operable to provide a desired support for the lumbar region of the back of the seat occupant to reduce occupant fatigue and adapt the seat to the comfortable support of different occupants.

Further objects, features and advantages of the invention will become apparent from a consideration of the following description, the appended claims and the accompanying drawing in which:

Figure 1:
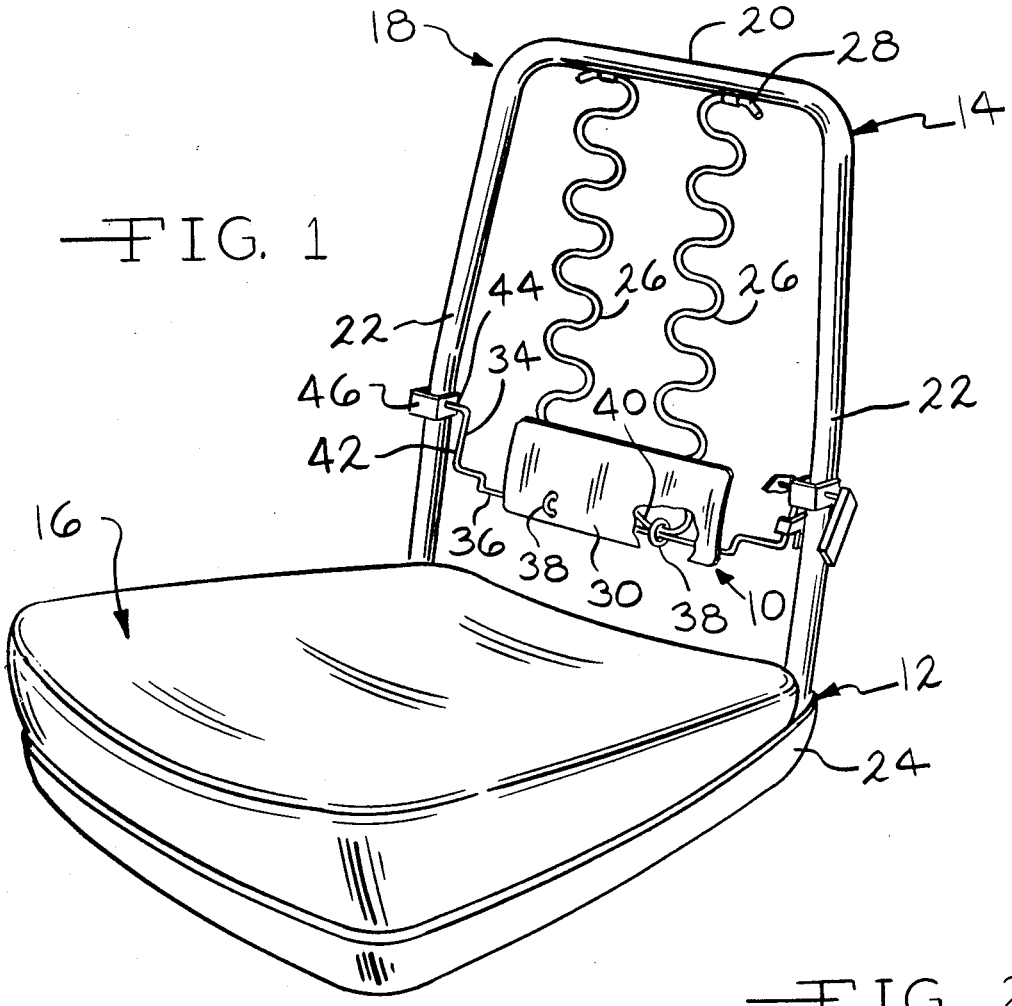
FIG. 1 is a perspective view of a vehicle seat with the upholstery removed from the seatback and showing the lumbar support mechanism of this invention in assembly relation therewith.

With reference to the drawing, the lumbar support mechanism of this invention, indicated generally at 10, is illustrated in FIG. 1 in assembly relation with a vehicle seat 12 having back and cushion portions 14 and 16, respectively. The seatback 14 includes a frame 18, of generally inverted U-shape, having top and side portions 20 and 22, respectively, and the seat cushion 16 includes a frame 24 on which the back frame 18 is supported. A pair of upright back springs 26, illustrated as being of conventional sinuous type, are secured at their upper ends 28 to the top portion 20 of the seatback frame 18 for a purpose to appear presently.

Figure 3:
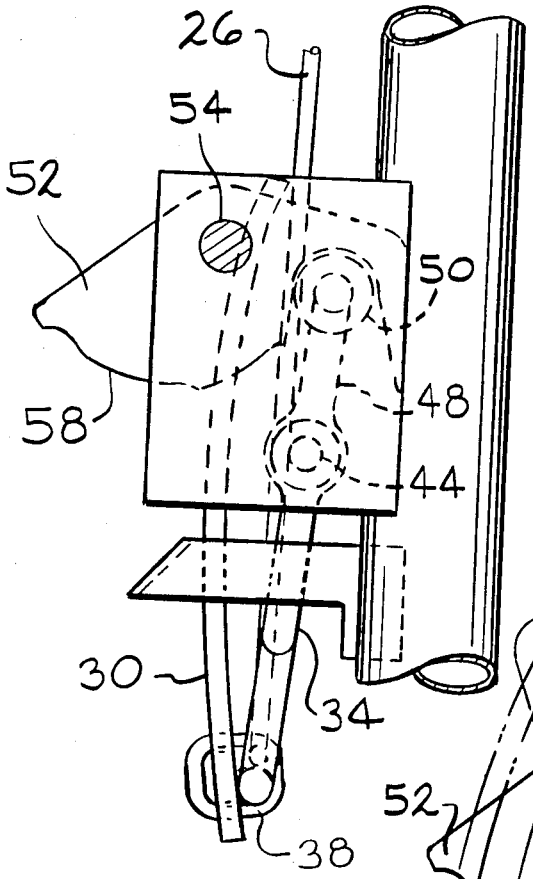
FIG. 3 is a side view of a portion of the seatback showing the lumbar support member in a retracted position.
Figure 5:
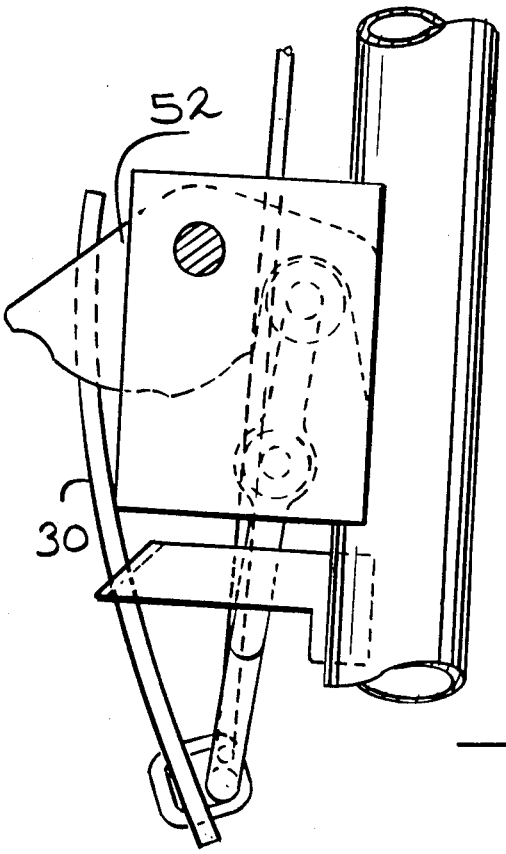
FIG. 5 is a side view like FIG. 3 showing the lumbar support member in a pivotally moved position relative to the position shown in FIG. 3, illustrating the second degree of freedom.
Figure 6:
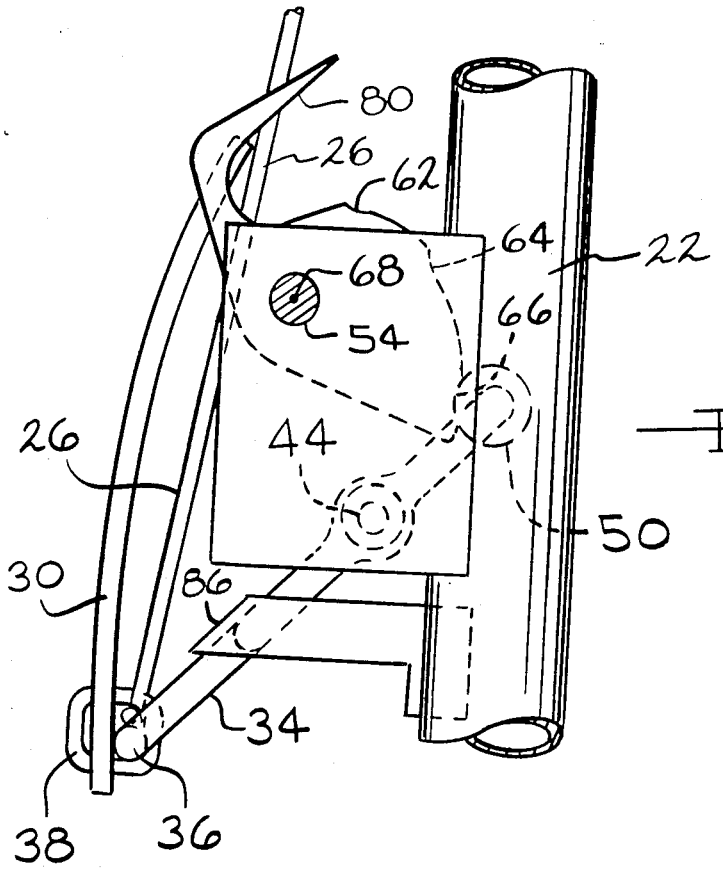
FIG. 6 is a side view like FIG. 3 showing the lumbar member in a fully extended position.

The lumbar support mechanism includes a lumbar support member 30 which is of generally rectangular plate or paddle shape and curved in a vertical plane to present a convex front side or surface 32 to the seat occupant. The support plate 30 is mounted on a support link or bar 34 which is of generally U-shape having a base portion 36 which is substantially straight and is pivotally connected to the support plate 30 by crimped C-Clips 38. The springs 26 are fastened at their lower ends to the lumbar support link 34 with the C-Clips 38. This attachment of the support plate 30 to the bar 34 enables the support plate 30 to maintain a generally vertical position but with a degree of freedom to enable it to adjust its vertical slope as illustrated in FIGS. 3 and 5, and the springs 26 bias the support force to the upper portion of the plate 30. As will more clearly appear hereinafter, this mounting of the lumbar support plate 30 enables the plate 30 to adjust to a sloped position corresponding to the slope of the seat occupant's back while providing upward torso support. This allows the occupant's back to assume a contour corresponding to the standing posture of the seat occupant which is the desired position for comfort purposes.

The support bar 34 also has end portions 42 which constitute legs or arms for supporting the base portion 36 for pivotal movement about end portions 44 of the bar 34 which are pivotally mounted on brackets 46 secured to the frame portions 22. The end portions 44 are aligned so that the bar 34 can rotate about a generally horizontal axis extending through the end portions 44 and extending transversely of the seatback 14.

As best illustrated in FIGS. 2–6, inclusive, the leg 42 at one end of the bar 34 is provided with an extension 48 which extends upwardly from the end portion 44 and carries a wheel shape follower 50 at its terminal end. A cam 52 is fixedly secured to a shaft 54 which extends horizontally through one of the brackets 46 and is rotatably supported thereon. The cam 52 is on one end of the shaft 54 adjacent the inner side of the back frame 18. An actuating handle or lever 56 is secured to the opposite end of the shaft 54 to enable manipulation of the handle 56 to rotate the cam 52 about a pivot axis 68 corresponding to the axis of the shaft 54. The cam 52 has a control side or surface 58 which is in continuous engagement with the follower 50 and is provided with a plurality of defined stop surface portions 60, 62, 64 and 66 which are located at progressively increasing distances from the pivot axis 68, as indicated by the imaginary radial chords shown at 70, 72, 74 and 76, respectively in FIG. 7.

Figure 7:
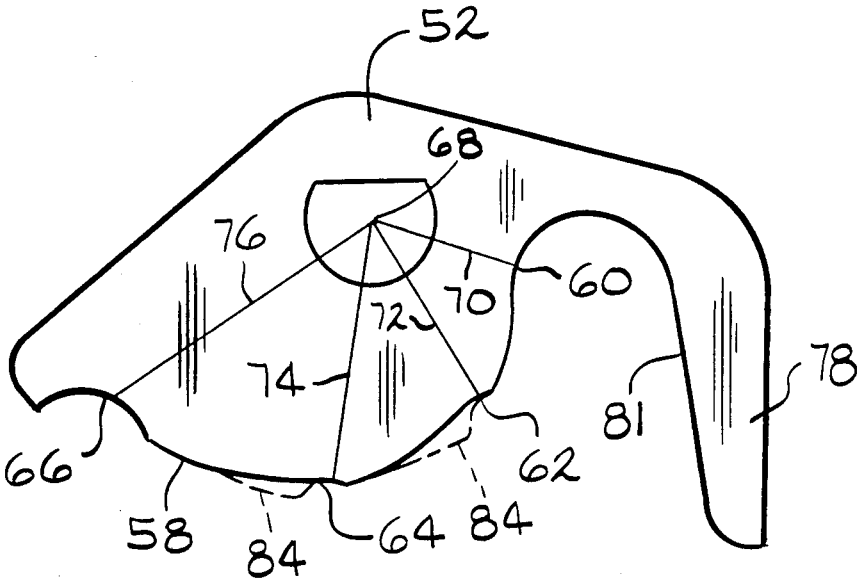
FIG. 7 is a side view of the control cam in the lumbar support mechanism of this invention.

As shown in FIG. 7, the control surface 58 terminates at one end in the stop surface 66 located at the end of the longest chord 76 and at the opposite end in the stop surface 60 which is located at the end of the shortest chord 70. Beyond the stop surface 60, the cam 52 is formed with a hook shape extension 78 having a stop wall 81 for a purpose to appear presently.

Figure 2:
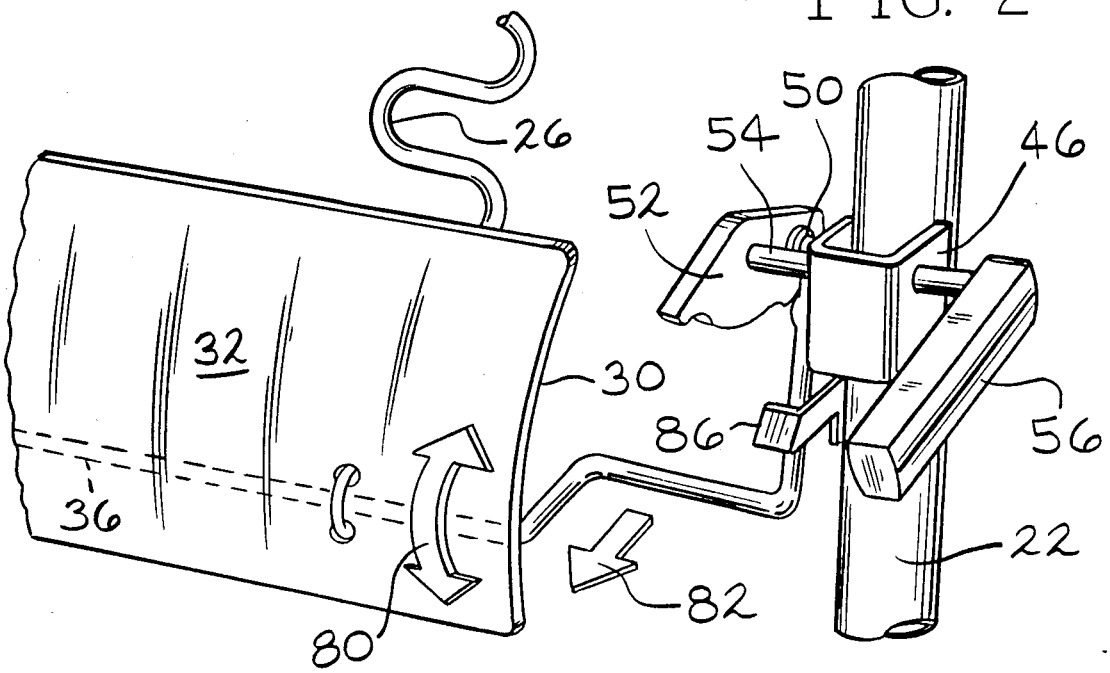
FIG. 2 is an enlarged fragmentary perspective view of a portion of the lumbar support mechanism shown in FIG. 1.

In the use of the lumbar support mechanism 10, assume that the actuating handle 56 is in the position illustrated in FIG. 2 in which the follower 50 is engaged with the stop surface 60. This position is illustrated in FIGS. 3 and 5 which illustrate that the support plate 30 is pivotally moveable about the support bar portion 36 in response to back pressure of the seat occupant to adjust the slope of the convex front surface 32 to adapt it to the slope of the back of the vehicle occupant. This degree of freedom which the mechanism provides for the lumbar support surface 32 is illustrated diagrammatically by the arrow 80 in FIG. 2.

Figure 4:
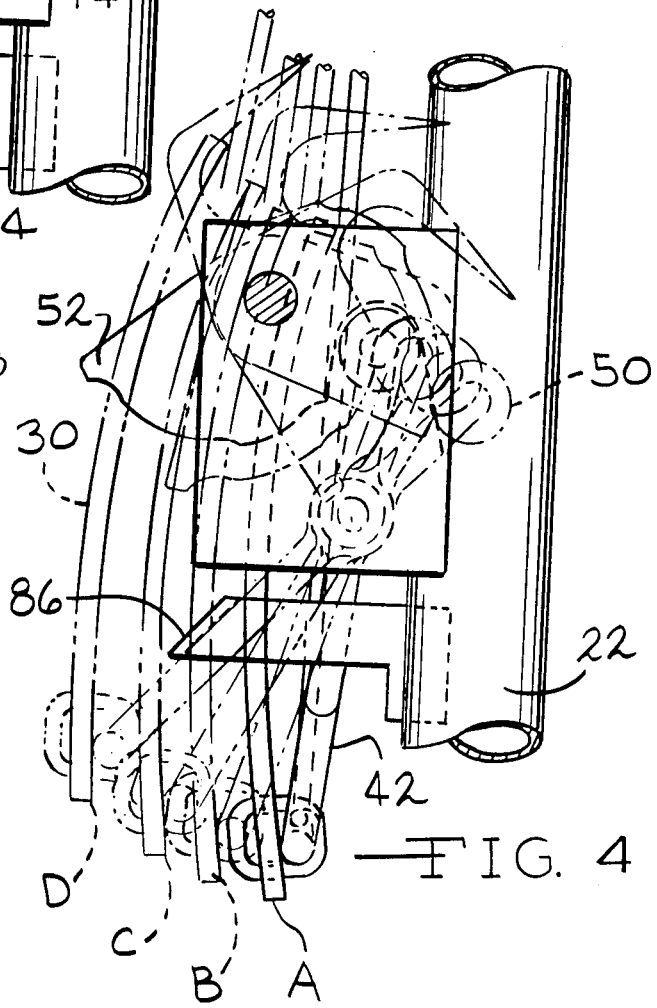
FIG. 4 is a side view like FIG. 3 showing the lumbar support member in a plurality of moved positions in broken lines to illustrate the first degree of freedom.

In the event increased lumbar support is desired by the seat occupant, the handle 56 is manually grasped and rotated in a counterclockwise direction as viewed in FIG. 2 to rotate the cam side surface 58 about the pivot axis 68 to, for example, a position in which the cam follower to is in engagement with the stop surface 62 which results in movement of the lumbar support plate 30 outwardly from its position indicated at A in FIG. 4 to its position shown at B in FIG. 4. This degree of freedom that is provided the lumbar support surface 32 in mechanism 10 of this invention is indicated diagrammatically by the arrow in 82 in FIG. 2.

To further increase the magnitude of the lumbar support force provided by the plate's convex surface 32, the vehicle occupant can continue counterclockwise rotation of the handle 56 to move the cam 52 about the pivot axis 68 to engage the stop surfaces 64 and 66 with the cam follower 50 resulting in movement of the support plate 30 to the positions indicated at C and D, respectively, in FIG. 4. A bracket 86 on one of the seatback frame members 22 is engageable with the support bar 34 to prevent rotation of the cam 52 past the point at which it engages the stop surface 66.

As shown in FIG. 7, by the broken lines 84, which depict imaginary surfaces on the control surface 58 of the cam 52, the cam surface 58 has been relieved on the upward side of the intermediate stop surfaces 62 and 64 so that the follower 50 can move smoothly along the cam surface 58. This eliminates the necessity for exerting high detent lift out forces on the cam 52 to move the cam to progressively increase the magnitude of the lumbar support provided by the plate 30. The result is smoothly operating mechanism with a large adjustment range which can be readily and with very low effort manipulated by a seat occupant manually operating the actuating handle 56.

In order to reduce the magnitude of the lumbar support or move the cam 50 to its minimum support position shown in FIGS. 2 and 3 in which the follower 50 is engaged with the stop surface 60, the handle 56 is rotated in a reverse direction, namely clockwise as viewed in FIG. 2, until the cam follower 50 has been positioned in a spot on the cam side surface 58 corresponding to the desired magnitude of lumbar support. This movement of the cam 52 in a reverse direction can also be accomplished by the seat occupant exerting rearward force on the lumbar support plate 30. To prevent this force from moving the follower 50 off the cam surface 58, the cam 52 is provided with the stop surface 60. Surface 81 engages the cam follower as the handle is rotated in a reverse direction and ensures the cam follower fully returns to the minimum adjustment position on the cam surface.

From the above description it is seen that this invention provides an improved lumbar support mechanism 10 with two degrees of freedom indicated diagrammatically by the arrows 80 and 82 in FIG. 2. In any one of the positions shown in FIG. 4 for the lumbar support plate 30, the support plate is pivotally moveable to adjust the slope of the plate 30 to conform to the slope of the occupant's back thereby imparting firm but comfortable lumbar support for the back of the seat occupant.

What is claimed is:

1. In a seat having back and cushion portions, a back frame generally having an inverted "U" shape with the top rail portion and a pair of side rail portions extending therefrom, adjustable lumbar support means on said back frame for a seat occupant, said adjustable lumbar support means comprising a convex plate shaped lumbar support member having a lower and an upper edge and extending transversely of said back frame, adjustable means carried by said back frame and mounting said lumbar support member for in and out movement in a direction laterally of said frame to vary the magnitude of occupant support obtainable from said lumbar support member said adjustable means including a transversely extending bar, means pivotally mounting said lumbar support member adjacent said lower edge thereof on said adjustable means bar for limited pivotal movement about the longitudinal axis of said bar to enable said lumbar support member to move in response to occupant pressure and thereby adapt its orientation to the slope of the seat occupant's back, and further comprising upright suspension springs secured to and extending between said back frame top portion and said adjustable means bar for providing a spring force on said adjustable means and said lumbar support member and acting to support on said lumbar support member adjacent said upper edge, said suspension springs having a first end connected to said back frame top rail portion and a lower second end and connection means for enabling said spring second end to pivot with respect to said adjustable means bar about an axis transversely of said back frame.

2. A lumbar support according to claim 1 wherein said adjustable means further comprises a pair of legs connecting with said bar and pivotally mounted on said back frame so that a pivotal movement of said legs causes said in and out movement of said lumbar member.

3. A lumbar support according to claim 1 wherein said lumbar support member being pivotally mounted on said adjustable means bar at a position on said lumbar member below the center of pressure acting on said lumbar support member so that said lumbar support member operates in conjunction with said suspension springs to impart an upward component to the lumbar support force supplied by said lumbar support member to the seat occupant.

* * * * *

UNITED STATES PATENT AND TRADEMARK OFFICE

CERTIFICATE OF CORRECTION

PATENT NO. : 4,725,095

DATED : February 16, 1988

INVENTOR(S) : Joseph B. Benson et al

It is certified that error appears in the above-identified patent and that said Letters Patent is hereby corrected as shown below:

Column 5, line 9, delete "on"

Signed and Sealed this

Second Day of August, 1988

*Attest:*

DONALD J. QUIGG

*Attesting Officer*

*Commissioner of Patents and Trademarks*